United States Patent [19]

Dobias

[11] Patent Number: 4,474,139

[45] Date of Patent: Oct. 2, 1984

[54] WATER HEATER STRUCTURE

[76] Inventor: John J. Dobias, 1212 Sumach Dr., Windsor, Ontario, Canada, N8S 2S4

[21] Appl. No.: 430,811

[22] Filed: Sep. 30, 1982

[51] Int. Cl.[3] ..... F22B 5/00

[52] U.S. Cl. ..... 122/13 R; 122/13 A; 122/16; 122/367 R; 122/160; 126/436; 126/375

[58] Field of Search ..... 122/13 R, 13 A, 16, 122/160, 367 R; 126/430, 436, 375, 361

[56] References Cited

U.S. PATENT DOCUMENTS

| | | | |
|---|---|---|---|
| 1,526,204 | 2/1925 | Campbell | 122/13 A |
| 1,734,274 | 11/1929 | Schubart | 122/367 R |
| 2,376,749 | 5/1945 | Belaieff | 165/153 |
| 2,440,998 | 5/1948 | Alexander | 122/19 |
| 2,592,863 | 4/1952 | Conner | 122/13 R |
| 3,076,445 | 2/1963 | Ohlhaver | 122/459 |
| 4,252,087 | 2/1981 | Kime | 122/367 R |
| 4,265,220 | 5/1981 | McAlister | 126/421 |

*Primary Examiner*—Henry C. Yuen

*Attorney, Agent, or Firm*—Barnes, Kisselle, Raisch, Choate, Whittemore & Hulbert

[57] ABSTRACT

A water heater having an inner water tank into which cold water is passed and from which hot water is periodically withdrawn including a jacket within the inner water tank constructed of material which absorbs and gives up heat rapidly whereby on periodic withdrawal of hot water from the inner water tank, cold water entering the inner water tank is rapidly heated by the jacket which has assumed the temperature of the hot water in the tank.

8 Claims, 5 Drawing Figures

FIG. 1
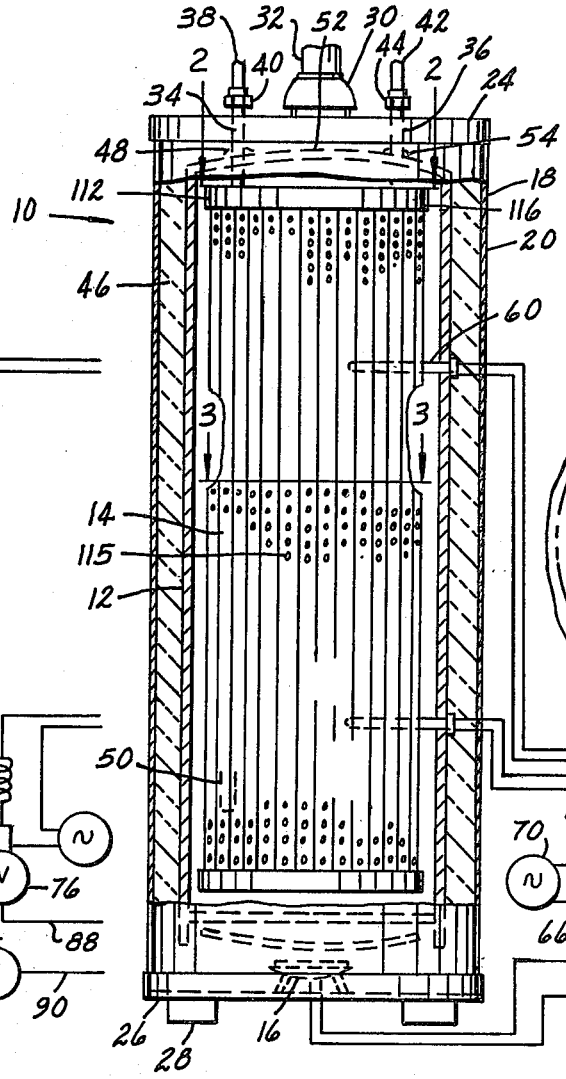
FIG. 5
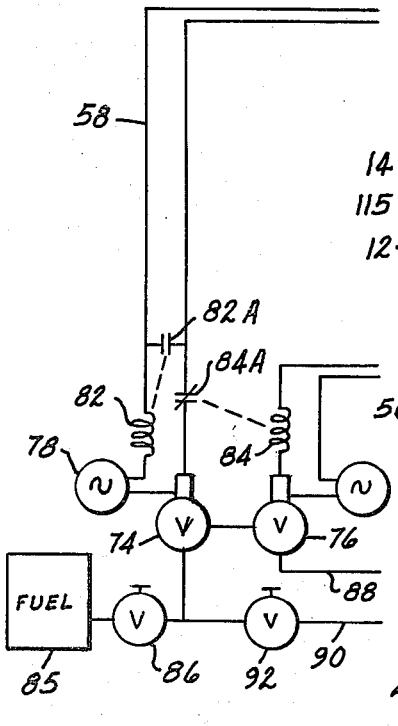
FIG. 4
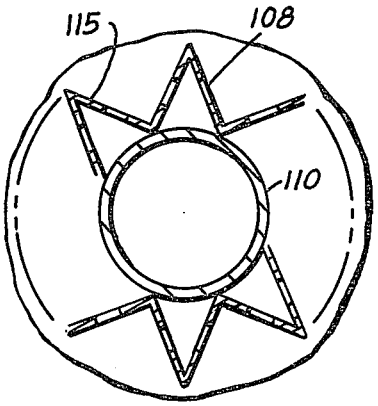
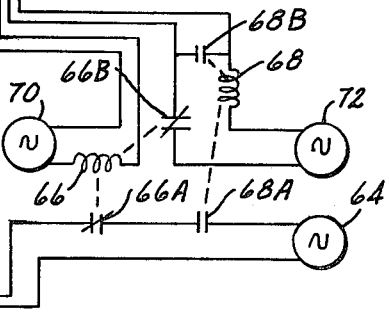
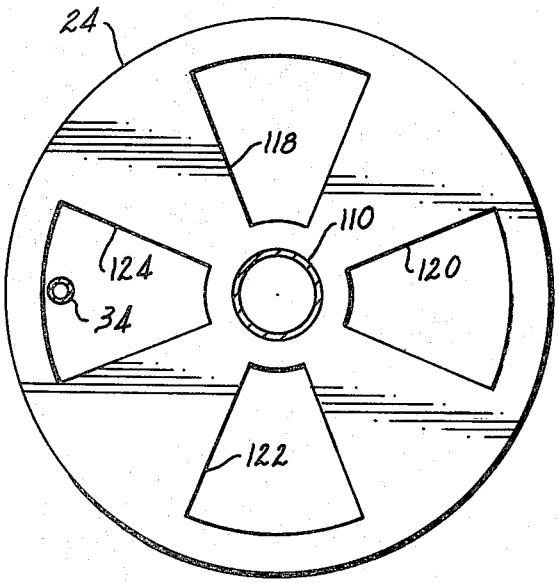
FIG. 2
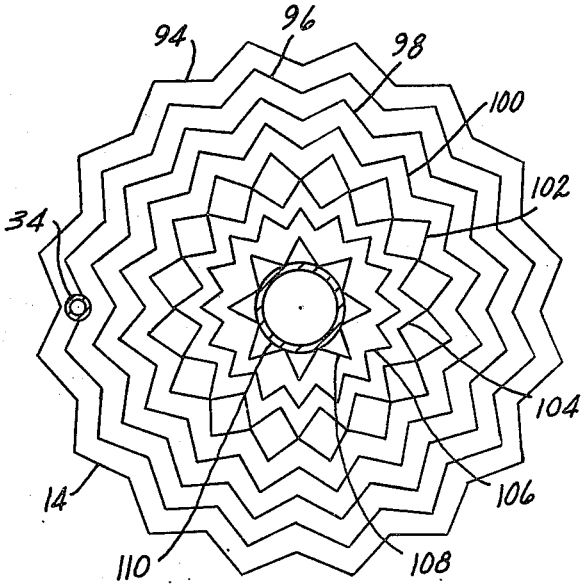
FIG. 3

WATER HEATER STRUCTURE

BACKGROUND OF THE INVENTION

1. Field of the Invention

The invention relates to water heaters and refers more specifically to a water heater including a water tank having a jacket therein constructed of material which rapidly absorbs heat from and gives up heat to water which jacket is an energy saver for the water heater.

2. Description of the Prior Art

In the past, water heaters for providing hot water for domestic use and the like, have generally included a water tank into which cold water is passed and from which hot water is periodically withdrawn. The water tanks of prior water heaters have usually been substantially empty except for the water passed thereinto and periodically withdrawn therefrom.

Such structures have recently been produced with thermostatic controls whereby heaters for heating the water in the water tank have been turned on when the temperature in an upper part of a tank has reached a predetermined minimum and turned off when the water in a lower portion of the water tank has reached a predetermined maximum temperature.

Such thermostatic controls provide an energy saving while providing continuous hot water without the necessity of manually turning the heaters on and off as water is used from the tank or cools down due to heat dissipation through the tank.

SUMMARY OF THE INVENTION

In accordance with the invention, a jacket of material which absorbs heat from and gives up heat to water rapidly is placed within the water tank of a water heater. The jacket is porous so that water diffuses therethrough.

Accordingly, hot water in the tank will cause the jacket to assume the temperature of the water during periods of non-use of the water. On withdrawal of a portion of the hot water from the water tank, cold water passed into the tank passes through the porous jacket and is substantially immediately heated by the hot jacket. The cold water entering the tank is thus

DESCRIPTION OF THE PREFERRED EMBODIMENT

In accordance with the invention, the water heater 10 illustrated best in FIG. 1, includes an internal water tank 12 having a jacket 14, therein constructed of material which absorbs heat from and gives up heat to water rapidly.

Thus, in operation, cold water passed into the tank 12 as hot water is withdrawn from the tank 12, is rapidly heated to a desired temperature at least partly by absorbing heat from the jacket 14.

Accordingly, due to the provision of the jacket 14, the length of time the heating means 16 for heating water in the tank 12 is turned on to bring water in the tank 12 up to a required temperature after hot water has been withdrawn from the tank 12, is reduced whereby energy is saved through the use of the jacket 14 with a consequent lower expense of operating the water heater 10.

More specifically, the water heater 10 includes an outer sheet metal casing 18 including an elongated cylindrical member 20 and upper and lower end caps 24 and 26. Leg members 28 are provided on the lower end cap 26 to space the end cap 26 from a floor or the like on which the water heater 10 is positioned. End cap 24 is provided with a central opening over which a chimney vent 30 is positioned for receiving the vent pipe 32.

End cap 24 is further provided with openings therethrough through which cold water inlet pipe 34 and hot water withdrawal pipe 36 extend into the tank 12. The cold water inlet pipe 34 is connected to a cold water supply line 38 as shown by coupling 40. Similarly, the hot water outlet pipe 36 is connected to a hot water supply line 42 by coupling 44.

Insulating material 46 is provided between the outer casing 20 and the inner tank 12 as shown. The insulating material 46 may be fiberglass or the like.

The cold water pipe 34 as indicated above, extends through the top cap 24 of the outer casing 18 and into the jacket 14. The cold water inlet pipe 34 is secured to the top 52 of tank 12 by convenient means such as a threaded opening or coupling 48 in the top 52. The cold water inlet pipe 34 extends axially of the cylindrical tank 12 and terminates adjacent the bottom of the jacket 14 at end 50.

The hot water outlet pipe 36 is also secured to the top 52 of the tank 12 by convenient means such as the the main gas line is closed when the temperature at the thermostatic switch 62 reaches a predetermined upper temperature and the electrical heating means 16 or gas is not turned on again until the thermostatic switch 60 senses a predetermined low temperature.

More specifically, as shown in FIG. 1, the heating means 16 is energized when both of the relay contacts 66A and 68A are closed from a source of electrical energy 64. Relay contacts 66A are normally closed when relay coil 66 is not energized. Relay controls 68A are normally open when relay coil 68 is not energized.

On closing, the thermostat switch 60 is by-passed by normally open contacts 68B due to energizing of relay coil 68 and remain by-passed until thermostatic switch 62 closes at a predetermined desired maximum water temperature to energizing relay coil 66 which opens normally, closed relay contacts 66A and 66B. Thermostatic switch 60 will not close again until the temperature of the water in the tank 12 has dropped to a predetermined low temperature for the water in the tank 12.

As shown heating means 16 is energized from a source of electrical energy 64 when relay contacts 63A and 65A are closed. Separate sources of electric energy 70 and 72 may be utilized to energize relay coils 66 and 68 or all three sources of electric energy 64, 70, and 71 may be the same.

Similarly, with a gas fired water heater 10, utilizing the thermostatic switches 60 and 62 and the gas fired system illustrated in FIG. 5, the solinoid actuated valves 74 and 76 are energized from separate sources of electrical energy 78 an 80 which may in practice be the same source of electrical energy in accordance with the opening and closing of the thermostatic switches 60 and 62.

Thus, the normally closed solinoid actuated valve 74 is energized to open the valve 74 on closing of the thermostatic switch 60 when the water in the tank 12 is below a predetermined minimum temperature and the valve 74 remains open due to the actuating of the normally open relay contacts 82A by relay coil 82 associated therewith until the thermostatic switch 62 closes. Thermostatic switch 62 closes when the water in the tank 12 is at a predetermined upper limit to energize relay coil 84 and open normally closed relay contacts 84A associated therewith and to close normally open solinoid actuated valve 76.

Thus, with the gas fired system 58 as the water temperature in the tank 12 reaches a lower limit temperature the thermostatic switch 60 closes to open the thermostatic valve 74 permitting gas from the gas source 85 to pass through the master on/off valve 86 in an open condition through the valve 74 and the valve 76 which is in an open condition when the thermostat switch 62 is open.

The heating means 16 which is in a gas fired system 58, a gas burner, is thus fed primary gas through the conduit 88 which is ignited due to the pilot gas provided to the heating means 16 through the conduit 90 and the pilot gas shut-off valve 92 in an open condition. The heating means 16 will then remain lit with the primary gas passing through the conduit 88 until the temperature of the water in the tank 12 reaches an upper limit at which time the thermostatic switch 62 will close to cause the valve 74 to close due to opening of contacts 84A and also close the valve 76.

Further, in accordance with the invention, there is provided within the inner tank 12 of the water heater 10, the jacket 14. As shown, the jacket 14 is constructed of eight separate corregated cylinders which are of different radii and are axially concentrically positioned about a central pipe 110. As shown best in FIG. 3, the outer five concentric corregated cylinders 94, 96, 98, 100 and 102 are angularly spaced from the inner three corregated cylinders by a distance equal to one-half of the angular extent of one corregation thereof. Further, the inner most corregated cylinder 108 is provided with only half of the number of corregations of the rest of the corregated cylinders.

In addition, as shown best in FIG. 1, each of the corregated cylinders is provided with small openings 115 extending transversely therethrough over substantially the whole surface thereof, whereby each of the corregated cylinders is porous, that is, water will pass therethrough but in a somewhat restricted manner.

The jacket 14, further, includes a top collar 112 and a bottom collar 114.

The top collar has the short, axially extending flange 116 thereon whereby it is slightly cupped-shaped to receive the upper ends of the corregated cylinders of the jacket 14, which may be secured thereto by convenient means such as brazing or the like. Further, the top collar 112 includes the angularly spaced apart openings 118,120,122, and 124, therein. As will be seen best in FIG. 2, the cold water inlet pipe 34 extends into the jacket 14 through the opening 124.

The bottom collar 114 is the same as the top collar 112, however, the bottom collar 114 is rotated angularly 45° with respect to the top collar 112 whereby the openings therethrough are completely offset from the openings through the top collar 112. Again, the bottom collar 114 is secured to the corregated cylinders by convenient means such as brazing or the like.

The jacket 14 may be constructed of any material which absorbs heat from and passes heat to water rapidly. For example, the jacket 14, may be constructed of twenty eight gage aluminum or copper.

Openings not shown may be provided extending radially into the jacket 14 and through the outer tank 12 to receive the thermostatic switch elements 60 and 62, respectively.

Thus, in overall operation, assuming the water heater 10 is an electric water heater and assuming that the water in the tank 12 is at a desired temperature, both the thermostatic switches 62 and 64 will be open. At this time, the jacket 14 will be at the desired temperature of the water in the tank 12. On withdrawal of hot water from the hot water withdrawal pipe 36, a number of things happen.

Thus, if the amount of hot water withdrawn which will be immediately replaced by cold water through the cold water inlet pipe 38 in the usual water heater system, is not large enough to cause the thermostatic switch 60 to close the cold water entering the water tank 12 will cause the temperature in the tank 12 to drop and the water in the tank 12 will absorb heat from the jacket 14, which will readily give up its heat to the water in the tank 12 and the system will become stabilized at a lower temperature very rapidly due to the large surface area of the jacket 14 and the circulation permitted therethrough. Due to the heat provided by the jacket 14, the temperature of the water in the tank 12 will drop very little.

If the amount of hot water withdrawn from the tank 12 permits sufficient cold water to enter the tank 12 to lower the temperature of the water in the tank below the temperature at which the thermostatic switch 60 closes, the heating means 16 will be energized to heat the water in the tank 12. The heating means 16 will remain on until the temperature of the water in the tank 12 reaches the maximum desired temperature for the water in the tank 12 at which time the switch 62 will close to shut-off the heater 16.

The time required for heating the water in the tank 12 will be greatly reduced due to the residual heat in the jacket 14 giving up its heat to the water in the tank 12. The time required for bringing the water in the tank 12 up to the desired maximum heat will be less than if the jacket 14 were not present in the tank 12. Accordingly, in accordance with the invention, the jacekt 14 increases the speed at which water in the tank 12 may be brought up to a desired maximum temperature and will thus, reduce the time necessary for the heater 16 to be on and will conserve energy and will thus be less expensive to operate.

It is hypothesized that the energy requirement for the water heater 10 may be reduced by as much as forty percent due to the inclusion therein of the jacket 14.

While one embodiment of the present invention has been considered in detail together with modification thereof, it will be understood that other embodiments and modifications of the invention are contemplated by the inventor. It is the intention to include all embodiments and modifications as are defined by the appended claims within the scope of the invention.

I claim:

1. A water heater comprising a water tank, means for heating the water in the water tank in accordance with the temperature thereof, a porous jacket within the water tank constructed of material which rapidly absorbs heat from water within the water tank and gives up heat rapidly to water within the water tank in accordance with the relative temperature of the water and the jacket, said porous jacket including a plurality of axially congruent, corregated cylinders of different radii having a plurality of transverse openings extending therethrough and end plates secured to both ends of the cylinders, means for passing cold water into the tank terminating within the porous jacket and means for periodically withdrawing hot water from the tank constructed and arranged to withdraw hot water from the top of the tank around the periphery of the porous jacket.

2. Structure as set forth in claim 1, wherein the end plates have openings therethrough which are angularly spaced apart on the top end bottom plates and the means for passing cold water into the porous jacket extends through an opening in the top plate and terminates adjacent the bottom of the jacket between openings in the bottom plate.

3. Structure as set forth in claim 2, wherein the jacket includes eight separate spaced apart corregated cylinders, the outer five of which are angularly offset with respect to the inner three by one-half of a corregation.

4. Structure as set forth in claim 3, wherein the inner corregated cylinder has half as many corregations therein as the rest of the corregated cylinders.

5. Structure as set forth in claim 1, wherein the jacket is constructed of one of aluminum and copper.

6. A water heater comprising an inner water tank, an outer shell, insulation between the outer shell and the inner water tank, means for heating water in the inner water tank in accordance with the temperature of the water in the inner water tank, a jacket within the inner water tank comprising a plurality of radially spaced apart, concentric, corregated cylinders having transverse openings therethrough whereby the jacket is porous, constructed of one of copper and aluminum, end plates on both ends of the jacket having openings therethrough which are angularly offset in the two end plates, a cold water pipe extending through the outer shell and into the inner tank terminating within the jacket adjacent the bottom thereof between openings in the bottom end cap and a hot water withdrawal type extending into the top of the inner tank through the outer shell.

7. Structure as set forth in claim 6, wherein the means for heating the water is electrical.

8. Structure as set forth in claim 6, wherein the means for heating the water is gas fired.

* * * * *